US007305942B2

(12) United States Patent
Chung et al.

(10) Patent No.: US 7,305,942 B2
(45) Date of Patent: Dec. 11, 2007

(54) ELECTROMECHANICAL VALVE ACTUATOR

(75) Inventors: Ha T. Chung, Canton, MI (US); Mark L. Hopper, West Chester, OH (US); John D. Norton, Candler, NC (US); Shawn H. Swales, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 221 days.

(21) Appl. No.: 11/064,986

(22) Filed: Feb. 23, 2005

(65) Prior Publication Data

US 2006/0185633 A1 Aug. 24, 2006

(51) Int. Cl.
*F01L 9/04* (2006.01)

(52) U.S. Cl. ..... 123/90.11; 251/129.01; 251/129.16

(58) Field of Classification Search ..... 123/90.11, 123/90.65, 90.66, 90.67, 90.12, 90.13; 251/129.01, 251/129.02, 129.15, 129.16
See application file for complete search history.

(56) References Cited

U.S. PATENT DOCUMENTS

| | | | |
|---|---|---|---|
| 4,762,095 A | 8/1988 | Mezger et al. | |
| 4,802,448 A | 2/1989 | Ableitner | |
| 5,704,314 A | 1/1998 | Allmendinger et al. | |
| 5,704,319 A | 1/1998 | Engelhardt et al. | |
| 5,762,035 A | 6/1998 | Schebitz | |
| 5,772,179 A | 6/1998 | Morinigo et al. | |
| 5,927,237 A | 7/1999 | Komatsu et al. | |
| 6,037,851 A | 3/2000 | Gramann et al. | |
| 6,047,673 A | 4/2000 | Lohse et al. | |
| 6,089,197 A | 7/2000 | Lange et al. | |
| 6,237,550 B1 | 5/2001 | Hatano et al. | |
| 6,262,498 B1 | 7/2001 | Leiber | |
| 6,289,858 B1 | 9/2001 | Altdorf et al. | |
| 6,302,370 B1 | 10/2001 | Schwoerer et al. | |
| 6,326,873 B1 | 12/2001 | Faria | |
| 6,352,059 B2 | 3/2002 | Stolk et al. | |
| 6,354,253 B1 | 3/2002 | Katsumata et al. | |
| 6,397,798 B1 | 6/2002 | Fiaccabrino | |
| 6,418,892 B1 | 7/2002 | Donce et al. | |
| 6,427,650 B1 | 8/2002 | Cristiani et al. | |
| 6,453,855 B1 | 9/2002 | Di Lieto et al. | |
| 6,467,441 B2 | 10/2002 | Cristiani et al. | |
| 6,477,994 B2 | 11/2002 | Umemoto et al. | |
| 6,502,804 B1 | 1/2003 | Schwegler et al. | |
| 6,516,758 B1 | 2/2003 | Leiber | |
| 6,517,044 B1 | 2/2003 | Lin et al. | |
| 6,526,928 B2 | 3/2003 | Bauer et al. | |
| 6,546,904 B2 | 4/2003 | Marchioni et al. | |
| 6,661,219 B2 | 12/2003 | Schmidt | |
| 6,691,654 B2 * | 2/2004 | Uehara et al. | 123/90.16 |
| 2001/0011533 A1 | 8/2001 | Stolk et al. | |
| 2002/0047707 A1 | 4/2002 | Schmidt | |
| 2002/0163329 A1 | 11/2002 | D'Alpaos et al. | |

(Continued)

FOREIGN PATENT DOCUMENTS

DE 10314860 A1 * 10/2004

(Continued)

*Primary Examiner*—Ching Chang
(74) *Attorney, Agent, or Firm*—Dickinson Wright PLLC

(57) ABSTRACT

An electromechanical valve actuator with an armature stem guidance system that ensures that the armature stem stays aligned with the valve stem during operation. The stem guidance system may also allow for adjustment of the lash gap during assembly.

15 Claims, 3 Drawing Sheets

U.S. PATENT DOCUMENTS

| | | | |
|---|---|---|---|
| 2003/0034470 | A1 | 2/2003 | Padroni |
| 2003/0056743 | A1 | 3/2003 | Cristiani et al. |
| 2003/0160197 | A1 | 8/2003 | Kodama |

FOREIGN PATENT DOCUMENTS

| | | |
|---|---|---|
| EP | 1 464 795 A2 | 10/2004 |
| JP | 2001-336663 | 12/2001 |
| JP | 2003-166406 | 6/2003 |

* cited by examiner

ELECTROMECHANICAL VALVE ACTUATOR

BACKGROUND OF THE INVENTION

The present invention relates to electromechanical valve actuators and more particularly to electromechanical valve actuators that are easy to assemble and include armature stem self-aligning features to ensure that the armature stem stays centered above the valve stem during operation.

As engine technology advances and manufacturers strive to increase engine power, improve fuel economy, decrease emissions, and provide more control over engines, manufacturers are developing electromechanical valve actuators (also known as electromagnetic valve actuators or EMVA) to replace camshafts for opening and closing engine valves. Electromechanical valve actuators allow selective opening and closing of the valves in response to various engine conditions.

Electromechanical valve actuators generally include two electromagnets formed from a lamination stack and an embedded power coil. A spring loaded lever armature located between the electromagnets is movable between the electromagnets as the power coils are selectively energized to create a magnetic force to attract the armature to the energized electromagnet. The surface of the electromagnets to which the armature is attracted when the power coil of an electromagnet is energized is generally referred to as a pole face. The armature is operationally coupled to the valve so that as the armature moves between pole faces in pole-face-to-pole-face operation, the valve is opened and closed.

Electromechanical valve actuators have typically been made as linear electromechanical valve actuators (not shown). Linear electromechanical valve actuators generally draw a substantial amount of power from the alternator and require significant space over the cylinder. In view of the drawbacks associated with linear electromechanical valve actuators, many manufacturers have recently been turning to lever electromechanical valve actuators, which due to their mechanical properties have substantial power savings and are more space efficient. One problem with lever electromechanical valve actuators is that, unlike linear electromechanical valve actuators, due to the mechanical properties of the pivoting lever armature plate, the armature stem also pivots. Pivoting of the armature stem may cause problems during operation, such as, keeping the armature stem, specifically end of the armature stem, aligned with the valve stem. Any misalignment of the armature stem with the valve stem may cause an operational fault, inefficient operation, or excessive wear. Therefore, there is a need for a lever electromechanical valve actuator with self-aligning features to ensure that the armature end of the armature stem stays aligned with the valve stem.

SUMMARY OF THE INVENTION

The present invention relates to electromechanical valve actuators and, more particularly to an electromechanical valve actuator with an armature stem guidance system that ensures that the armature stem stays aligned with the valve stem during operation. The stem guidance system may also allow for adjustment of the lash gap during assembly.

In a first embodiment, the present invention is directed to an electromechanical valve actuator having an armature stem, a valve stem, and a lash cap between the armature stem and the valve stem, and wherein the lash cap has first surface defining a cavity for receiving the armature stem. The armature stem includes an armature end having a center point that is approximately aligned with the valve stem axis, when the armature stem is received in the cavity. The lash cap has a thickness, the thickness of the lash cap being selected to compensate for tolerance variations in the electromechanical valve actuator, which includes tolerance variations in the actuator portion and the head portion.

In a second embodiment, the present invention is directed to an electromechanical valve actuator comprising a spring assembly having an armature spring retainer and a valve spring retainer, an armature stem coupled to the armature spring retainer, a valve stem coupled to the valve spring retainer and wherein the valve spring retainer defines a cavity for receiving the armature stem, and a lash cap located within the cavity and between the armature stem and the valve stem. The valve spring retainer may further include a lock assembly defining the cavity. The valve spring retainer may also form the cavity such that the valve spring retainer includes an inside diameter and the armature stem includes an armature stem diameter, the armature stem diameter being smaller than the valve spring retainer inside diameter, however, in this sub-embodiment, the lock assembly has an inside diameter that is less than the armature stem diameter.

In a third embodiment, the present invention is directed to an electromechanical valve actuator comprising a spring assembly including an armature spring retainer, an armature spring, a valve spring and a valve spring retainer; an armature stem coupled to the armature spring retainer; a valve stem coupled to the valve spring retainer; and a lash cap located between the armature stem and the valve stem and having a thickness and wherein one of the valve spring retainer and the lash cap defines a cavity for receiving the armature stem, the electromechanical valve actuator assembled by the process of: determining tolerance variations of the electromechanical valve actuator; selecting the lash cap having a thickness; and inserting the lash cap between the armature stem and the valve stem.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
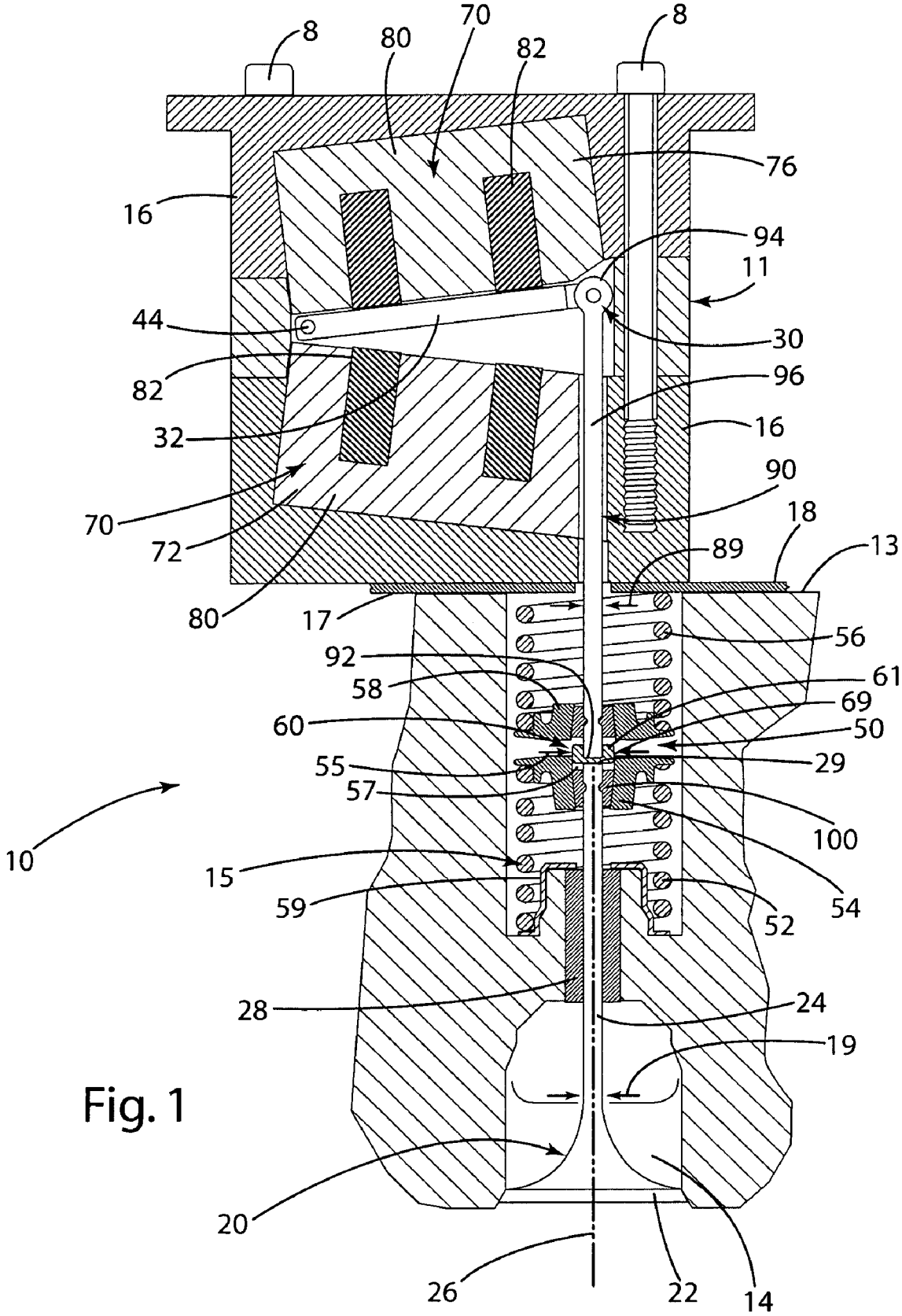
FIG. 1 is a sectional view of the electromechanical valve actuator.

A lever electromechanical valve actuator 10, mounted on an internal combustion engine 12 to open and close a valve 20 to a valve port 14 (e.g., the intake or exhaust valves), is illustrated in FIG. 1. The electromechanical valve actuator 10 generally includes an armature assembly 30 having an armature plate 32 and an armature stem 90; an electromagnet assembly 70 having electromagnets 72, 76; a spring assembly 50; and a guidance mechanism 60. The armature plate 32 is alternatively attracted to the electromagnets 72, 76 thereby applying a bi-directional force to the spring assembly 50 through the armature stem 90 to open and close the valve 20.

The valve 20 is similar to traditional valves and generally includes a valve head 22 with a valve stem 24 extending therefrom and having a valve stem diameter 19. The valve 20 has an open and a closed position wherein in the closed position, the valve head 22 seals a valve port 14 to a corresponding cylinder. The valve stem 24 moves along a valve stem axis 26 as the valve 20 is opened and closed.

Figure 2:
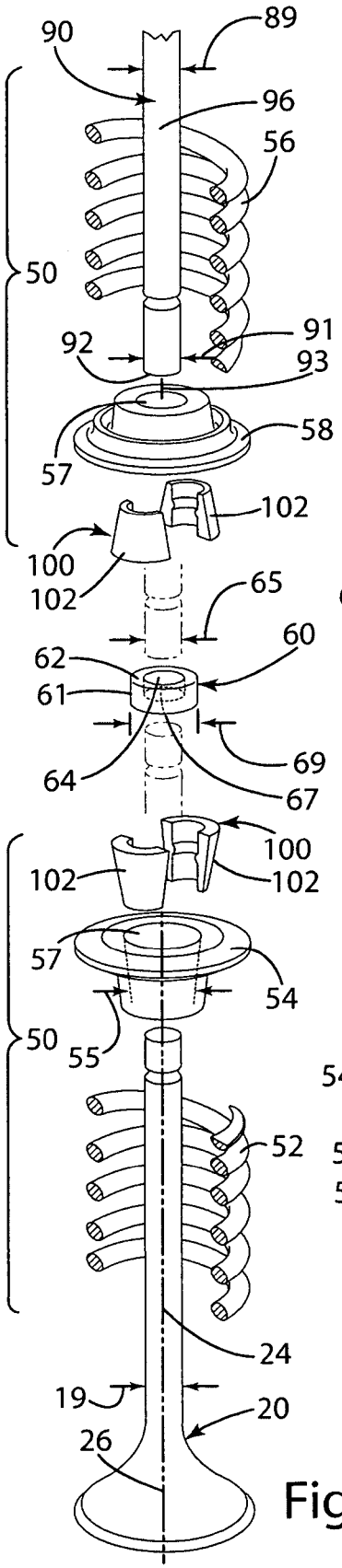
FIG. 2 is a perspective exploded view of a portion of the electromechanical valve actuator.

The spring assembly 50 includes springs 52 and 56 to bias the armature plate 32 into an intermediate position (not shown) while the electromagnets 72, 76 are not energized. The spring assembly 50 further includes a valve spring retainer 54 coupled to the valve stem 24 and an armature spring retainer 58 coupled to the armature stem 90 (FIG. 1). The spring retainers 54, 58 operationally couple the springs 52, 56 to the valve stem 24 and armature stem 90. The spring retainers 54 and 58 generally include a retainer cavity 57 having an inner diameter 55. The spring retainers 54 and 58 also further include a lock assembly 100 to couple the retainers 54 and 58 to the valve stem 24 or armature stem 90. The lock assembly 100 generally includes two keepers 102 as is well known in the art (FIG. 2).

The electromagnet assembly 70 controls the movement of the armature assembly 30 and thereby the movement of the valve 20. The electromagnets 72, 76 each include cores 80 which may be formed from laminated plates (not shown) to improve the magnetic efficiency of the electromagnets 72, 76. A coil 82 is situated within each core 80 and is selectively energized to attract the armature plate 32 to the electromagnets 72, 76. The electromagnets 72, 76 are generally secured to a housing 16 and a base plate 18 may be located between the housing 16 and internal combustion engine 12 to provide support to the armature spring 56.

As discussed above, the armature assembly 30 includes the armature plate 32 and the armature stem 90. The armature stem 90 includes an armature end 92 having an outside diameter 91 and a centerpoint 93, which is generally the center of the outside diameter 91 at the armature end 92. The armature stem 90 also includes a tip 94 opposing the armature end 92. The armature plate 32 pivots about an armature pivot axis 44, to open and close the valve 20. The armature stem 90 is coupled to armature plate 32 opposite the armature pivot axis 44 in a manner that transmits force from the armature plate 32 to the armature stem 90. The present invention is shown in FIG. 1 with the armature stem 90 receiving forces from the armature plate 32 in both the opening and closing directions during operation, due to the configuration of the spring assembly 50. However, it should be readily apparent to one skilled in the art that the present invention may also be applied to an electromechanical valve actuator wherein force is transmitted to the armature stem 90 only in the opening directions due to the use of a torsion bar, other mechanism, or through rearrangement of the springs 52, 56 (not shown) to apply force to the armature plate 32 in the closed direction independent of the armature stem 90.

The present invention also includes a guidance mechanism 60. The guidance mechanism is generally a cavity sized to receive and retain the armature stem 90 so that the centerpoint 93 of the armature end 92 is approximately aligned or in operation with the valve stem axis 26 and substantially prevented from moving axially relative to said valve stem 24. In other words, the cavity concentrically restrains the movement of the armature stem 90 relative to the valve stem 24 while still allowing movement of the armature stem 90 relative to the valve stem 24 along the valve stem axis 26. By keeping the centerpoint 93 approximately aligned with the valve stem axis 26 the electromechanical valve actuator 10 may operate more efficiently in that forces applied by the armature plate 32 to the armature stem 90 are predominantly transferred along the valve stem axis 26. By keeping the armature stem 90 approximately aligned with the valve stem 24, the amount of force required to open the valve 20 is less than an electromechanical valve actuator 10 where the force applied to the valve 20 is not approximately aligned with the valve stem axis 26. Not only is the force reduced, but the wear on the valve stem bushing 28 and valve stem 24 is reduced by maintaining the concentric alignment. Another advantage of the guidance mechanism 60 keeping the armature stem 90, particularly the centerpoint 93, concentrically aligned with the valve stem 24 is that the guidance mechanism 60 may also ensure that the armature stem 90 does not become misaligned with the valve stem 24 due to the pivoting nature of the armature plate 32 thereby causing an operational fault.

Figure 3:
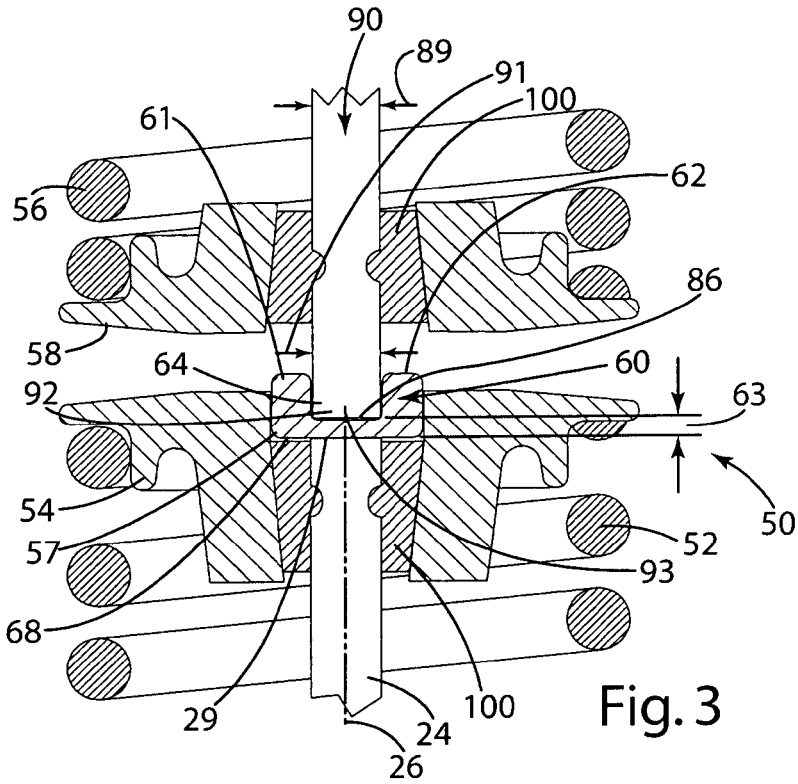
FIG. 3 is an enlarged sectional view of the spring assembly and a lash cap with a first thickness.
Figure 4:
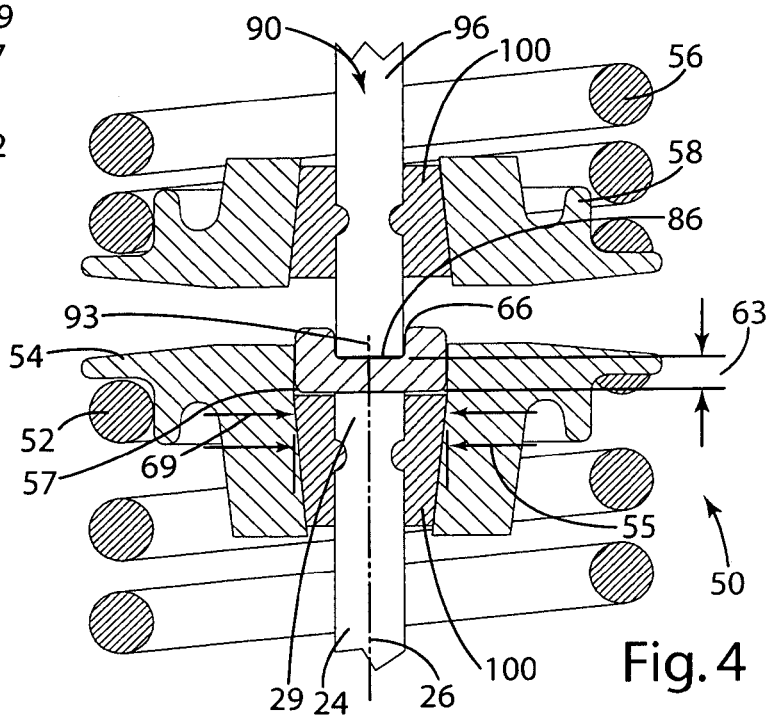
FIG. 4 is an enlarged sectional view of the spring assembly and a lash cap with a second thickness.

In the illustrated embodiment, the guidance mechanism 60 is formed using a lash cap 61 having a first surface 62 defining a cavity 64 (FIGS. 1 and 2). The lash cap 61 further includes a second surface 68 that engages the valve stem and has an outer diameter 69. The cavity 64 has an inner diameter 65 for receiving the armature stem 90. More specifically, the inner diameter 65 of the cavity 64 is larger than the armature end outer diameter 91. For ease of assembly, the lash cap 61 further includes rounded edges 66 where the cavity 64 meets the first surface 62. The lash cap 61 also has a thickness 63 between the bottom of the cavity 67 and the second surface 68. The thickness 63 is selected to adjust for tolerance differences so that the electromechanical valve actuator 10 has the proper lash gap 86 to allow for thermal expansion differences. Lash caps 61 with different thicknesses 63 are illustrated in FIGS. 3 and 4.

Figure 5:
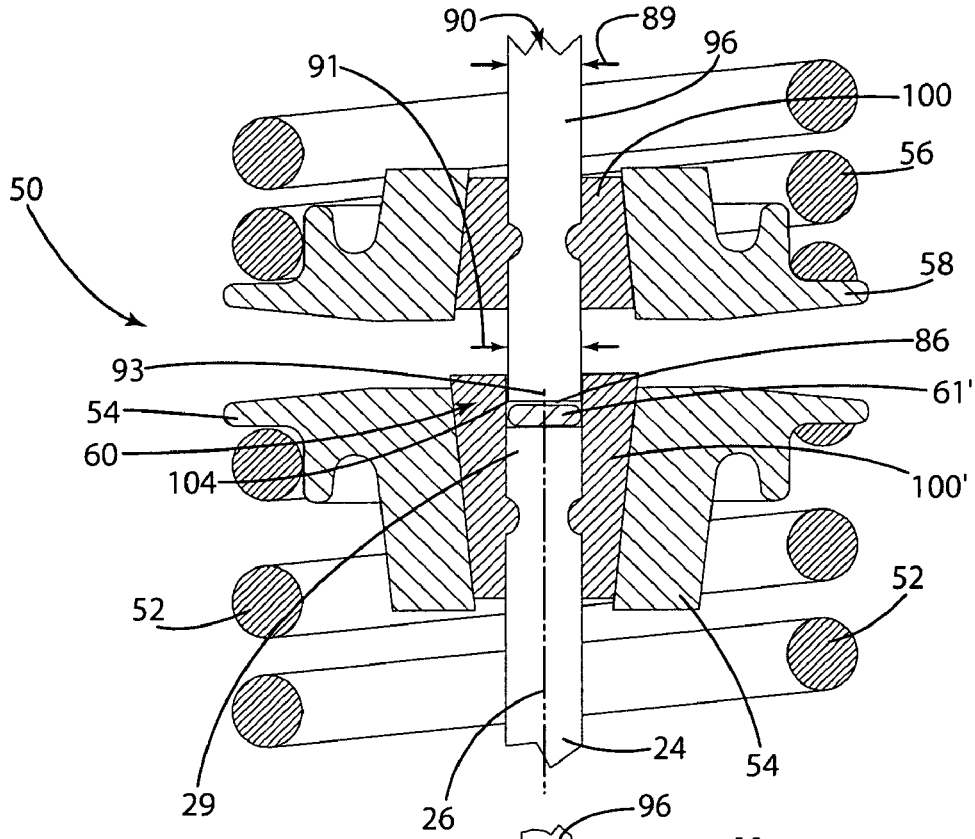
FIG. 5 is an enlarged sectional view of a first alternative embodiment of the spring assembly and lash cap.

In a first alternative embodiment illustrated in FIG. 5, the guidance mechanism 60 may also be formed using a cavity 104 defined by the locking mechanism 100. The locking mechanism 100 may be configured to extend beyond the valve stem 24 to create a cavity 104 into which the armature stem 90 is received. A lash cap 61' having two flat surfaces may be inserted between the armature stem 90 and the valve stem 24 to adjust for tolerance differences and thereby to provide the proper lash gap.

Figure 6:
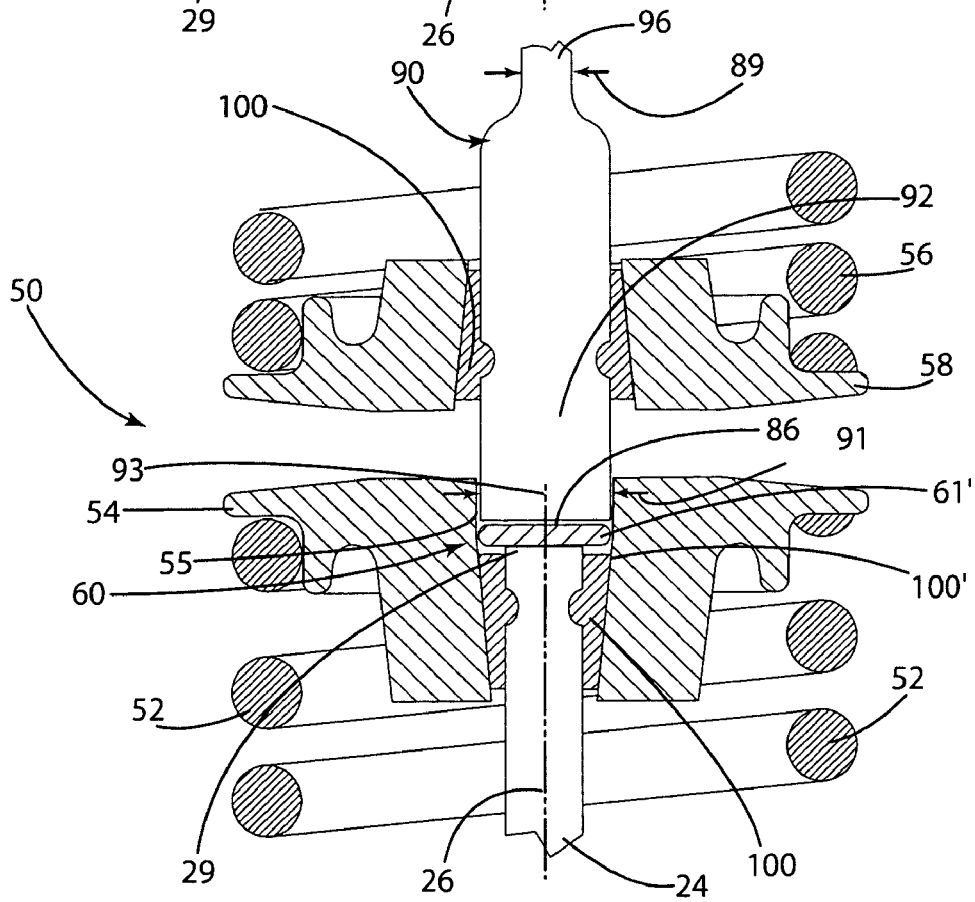
FIG. 6 is an enlarged sectional view of a second alternative embodiment of the spring assembly and lash cap.

In a second alternative embodiment illustrated in FIG. 6, the armature stem 90 may be configured to have an armature end outer diameter 91 that is larger than the valve stem's diameter. With a larger armature stem diameter 91, as shown in FIG. 6, the valve spring retainer 54 may receive the armature stem 90 within the retainer cavity 57. The outside diameter 91 of the armature stem 90 is enlarged to fit within the retainer cavity 57 with minimal movement axially relative to the valve stem axis 26 by the centerpoint 93. A lash cap 61' having two flat surfaces may be inserted between the armature stem 90 and the valve stem 24 to adjust for tolerance differences to provide the proper lash gap.

The electromechanical valve actuator 10 is generally assembled onto an engine 12 as is well known in the art with the addition of assembling the guidance mechanism 60 onto the electromechanical valve actuator 10. The electromechanical valve actuator 10 generally includes an actuator portion 11 and a head portion 15. An exemplary method of assembling the actuator portion 11 and the head portion 15 is described below, however it should be readily apparent to one skilled in the art that changes in the steps, added steps, or any other changes in the assembly process may be made without departing from the spirit of the invention. The actuator assembly is generally assembled by forming the valve electromagnets 72 and armature electromagnet 76 and respectively assembling these electromagnets 72, 76 into the housing 16. The armature assembly 30 is then installed with the armature stem 90 passing through the valve electromagnet 72. The armature spring 66 and armature spring retainer 58 are then installed and coupled to the armature stem 90 with the locking assembly 100. The head portion 15 is also generally assembled by installing the valve 20 into the internal combustion engine 12, specifically the cylinder head of an internal combustion engine. If necessary, a valve spring guide 59 (FIG. 1) can also be installed with the valve spring 52 being installed thereupon. The valve spring retainer 54 is then coupled to the valve stem 20 with the locking assembly 100. With the actuator portion 11 and head portion 15 being assembled, the guidance mechanism 60 is assembled onto either the head portion 15 or actuator portion 11 before the two portions 11, 15 are assembled together to form the electromechanical valve actuator 10. It should be readily recognized to one skilled in the art that the actuator portion 11 and head portion 15 may be assembled at different places at different times and also that a third assembly location may provide the assembly of the guidance mechanism 60 and the actuator portion 11 onto the head portion 15 to create the electromechanical valve actuator 10.

Before the guidance mechanism 60 is installed, the proper thickness 63 of the lash cap 61, 61' must first be determined. The thickness 63 of the lash cap 61 or 61' between the armature stem 90 and valve stem 24 adjusts for tolerance differences, specifically the tolerance difference between the base plane 17 of the base plate 18 through the armature end 92 of the armature stem 90 and the tolerance difference between the mounting plane 13 of the internal combustion engine 12 and the valve end 29 of the valve stem 24. Of course, the tolerance differences can be measured from any other reference point, but using the mounting plane 13 and base plane 17 as a reference point allows easy measuring of the tolerance differences because when the base plate 18 is mounted on the internal combustion engine 12, the mounting plane 13 and base plane 17 basically form the same planes. Therefore, calculations of the proper thickness 63 may easily be determined. For example, where the desired lash gap for a particular engine is known, to determine the thickness of the washer, the difference is calculated between the distance between the mounting plane 13 and armature end 92 and the difference between the mounting plane 13 and the valve stem end 29. The lash gap is then subtracted from this calculated difference, which provides the desired thickness. For example, if the distance between the mounting plane 13 and the armature end 92 is 4.97 and the distance between the base plane 17 and valve stem end 29 is 4.56 and the desired lash gap is 0.18, then 4.56 is subtracted from 4.97 and then the lash gap of 0.18 is subtracted therefrom to give a desired thickness of 0.23. Once the desired thickness is determined, a lash cap 61 or 61' is selected having the closest thickness 63 and inserted into the retainer cavity 57 of the valve spring retainer 54 or the cavity 104 formed by the locking assembly 100. The actuator portion 11 is then installed on the cylinder head of the internal combustion engine 12 to form the electromechanical valve actuator 10. The bolts 8 on the electromechanical valve actuator 10 are then tightened.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A lever electromechanical valve actuator comprising:

a spring assembly having an armature spring retainer and a valve spring retainer;

an armature stem coupled to said armature spring retainer;

a valve stem coupled to said valve spring retainer and wherein said valve spring retainer defines a cavity for receiving and concentrically restraining said armature stem; and a lash cap located within said cavity and between said armature stem and said valve stem.

2. The electromechanical valve actuator of claim 1 wherein said valve spring retainer includes an inside diameter and said armature stem includes an armature stem diameter, said armature stem diameter being smaller than said valve spring retainer inside diameter.

3. The electromechanical valve actuator of claim 2 wherein said valve spring retainer includes a lock assembly having a lock assembly inside diameter and wherein said armature stem diameter is greater than said lock assembly inside diameter.

4. The electromechanical valve actuator of claim 1 wherein said armature stem includes an armature end having a center point and wherein said valve stem includes a valve stem axis and wherein when said armature stem is received within said cavity, said center point is approximately aligned with said valve stem axis.

5. The electromechanical valve actuator of claim 1 wherein said lash cap has a thickness, the thickness of said lash being selected to compensate for tolerance variations in said electromechanical valve actuator.

6. A lever electromechanical valve actuator comprising:

a spring assembly having an armature spring retainer and a valve spring retainer;

an armature stem coupled to said armature spring retainer;

a valve stem coupled to said valve spring retainer with a lock assembly defining a cavity for receiving said armature stem; and a lash cap located within said cavity and between said armature stem and said valve stem.

7. The electromechanical valve actuator of claim 6 wherein said lock assembly couples said valve spring retainer to said valve stem.

8. The electromechanical valve actuator of claim 6 wherein said lash cap has a thickness, the thickness of said lash being selected to compensate for tolerance variations in said electromechanical valve actuator.

9. An electromechanical valve actuator comprising:

a spring assembly including an armature spring retainer, an armature spring, a valve spring and a valve spring retainer;

an armature stem coupled to said armature spring retainer;

a valve stem coupled to said valve spring retainer with a lock assembly; and a lash cap located between said armature stem and said valve stem and having a thickness and wherein one of said valve spring retainer and said lock assembly defines a cavity sized to receive and retain said armature stem, said electromechanical valve actuator assembled by the process of:

determining tolerance variations of the electromechanical valve actuator;

selecting said lash cap having a thickness, said thickness being selected based upon the determined tolerance variations; and inserting said lash cap between said armature stem and said valve stem to minimize the gap between the armature stem and the valve stem.

10. The electromechanical valve actuator of claim 9 wherein said electromechanical valve actuator further includes an actuator portion having a base plane and a head portion having an mounting plane and wherein said valve stem includes a valve end and said armature stem includes an armature end and wherein said step of determining tolerance variations further includes the steps of measuring a distance from a said base plane to said armature end and measuring a distance from said mounting plane to said valve end.

11. The electromechanical valve actuator of claim 10 wherein said lash cap has a thickness and wherein said process of determining said tolerance variations further includes the step of determining the difference between said distance from said base plane to said armature end and said distance from said mounting plane to said valve end, and subtracting a desired lash gap from said difference to determine the desired thickness of said lash cap.

12. The electromechanical valve actuator of claim 11 wherein said step of selecting a lash cap having a thickness includes the step of selecting a lash cap with a thickness that is closest to the desired thickness.

13. An electromechanical valve actuator comprising:

an armature plate;

an armature stem coupled to said armature plate;

a spring assembly including a valve spring and a valve spring retainer;

a valve stem coupled to said valve spring retainer with a lock assembly; and a lash cap between said armature stem and said valve stem, and wherein one of said valve spring retainer and said lock assembly directly engages one of said lash cap and armature stem and wherein said armature stem is concentrically restrained by said lash cap and said valve spring retainer directly engages and concentrically restrains said lash cap.

14. An The electromechanical valve actuator comprising:

an armature plate;

an armature stem coupled to said armature plate;

a spring assembly including a valve spring and a valve spring retainer;

a valve stem coupled to said valve spring retainer with a lock assembly; and a lash cap between said armature stem and said valve stem, and wherein said lock assembly directly engages and concentrically restrains said armature stem.

15. An electromechanical valve actuator comprising:

an armature plate;

an armature stem coupled to said armature plate;

a spring assembly including a valve spring and a valve spring retainer;

a valve stem coupled to said valve spring retainer with a lock assembly; and a lash cap between said armature stem and said valve stem, and wherein said valve spring retainer directly engages and concentrically restrains said armature stem.

* * * * *

UNITED STATES PATENT AND TRADEMARK OFFICE

CERTIFICATE OF CORRECTION

PATENT NO. : 7,305,942 B2
APPLICATION NO. : 11/064986
DATED : December 11, 2007
INVENTOR(S) : Ha T. Chung et al.

It is certified that error appears in the above-identified patent and that said Letters Patent is hereby corrected as shown below:

Column 8, line 15, Claim 14, after "An" delete "The".

Signed and Sealed this

Twenty-ninth Day of January, 2008

JON W. DUDAS
*Director of the United States Patent and Trademark Office*